US008393406B2

(12) United States Patent
Seal

(10) Patent No.: US 8,393,406 B2
(45) Date of Patent: Mar. 12, 2013

(54) SPREADER/GRADER SYSTEM

(75) Inventor: Richard A. Seal, Picayune, MS (US)

(73) Assignee: Domor Equipment, LLC, Eureka, IL (US)

( * ) Notice: Subject to any disclaimer, the term of this patent is extended or adjusted under 35 U.S.C. 154(b) by 88 days.

(21) Appl. No.: 12/916,791

(22) Filed: Nov. 1, 2010

(65) Prior Publication Data

US 2012/0048578 A1 Mar. 1, 2012

Related U.S. Application Data

(60) Provisional application No. 61/377,264, filed on Aug. 26, 2010.

(51) Int. Cl.
*A01B 39/00* (2006.01)

(52) U.S. Cl. ..... 172/393; 172/445.1; 172/684.5; 404/118

(58) Field of Classification Search ..... 172/445.1, 172/684.5, 799.5, 393; 404/96, 118, 119
See application file for complete search history.

(56) References Cited

U.S. PATENT DOCUMENTS 1,232,314 A 7/1917 Hubbard
1,393,385 A * 10/1921 Lyttle et al. ..... 172/684.5
3,276,153 A * 10/1966 Sorensen ..... 172/387
4,196,778 A * 4/1980 Smith ..... 172/445.1
4,320,988 A 3/1982 Seal
4,630,686 A 12/1986 Ausmus, Jr.
4,655,297 A 4/1987 Bourgeois
4,917,533 A 4/1990 Wilson
5,191,943 A 3/1993 Minor et al.
5,332,331 A * 7/1994 Critz et al. ..... 404/96
5,397,200 A * 3/1995 Seal ..... 404/118
5,427,185 A * 6/1995 Seal ..... 172/684.5
6,283,225 B1 * 9/2001 Hermonson ..... 172/817
6,695,532 B2 * 2/2004 Somero et al. ..... 404/118
8,083,005 B1 * 12/2011 Nicolai ..... 172/393

* cited by examiner

*Primary Examiner* — Jamie L McGowan
(74) *Attorney, Agent, or Firm* — Garvey, Smith, Nehrbbass & North, L.L.C.; Gregory C. Smith; Julia M. FitzPatrick

(57) ABSTRACT

An improved spreader/grader system, which includes a frame having a pair of parallel sidewalls; a plurality of spreader/grader blades positioned between the sidewalls and secured within a slot along the length of each of the sidewalls, each blade having a lower edge for spreading or grading a surface upon which the spreader/grader rests; a hydraulic cylinder attached to each end of each blade to allow each blade to be moveable along the length of the sidewall in a parallel or non-parallel relationship as desired by the operator; and a hydraulic cylinder system for attaching the frame to a vehicle, such as a tractor, for pulling the spreader/grader during the spreading/grading process. The blades of the spreader/grader may alternatively be secured in fixed positions between the sidewalls of the frame with a bolt/nut combination.

11 Claims, 11 Drawing Sheets

SPREADER/GRADER SYSTEM

CROSS-REFERENCE TO RELATED APPLICATIONS

Priority of U.S. Provisional Patent Application Ser. No. 61/377,264, filed Aug. 26, 2010, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to graders. More particularly, the present invention relates to an improved spreader/grader of the type pulled by a tractor, having a plurality of grader blades which are adjustable to multiple positions either manually or by other force, such as hydraulic or pneumatic power.

2. General Background of the Invention

The named inventor of the present invention is the patentee in U.S. Pat. No. 5,332,331, on a combination grader/spreader apparatus having a pair of substantially parallel sidewalls, spaced apart, and supporting at least two spreader/grader blades therebetween. There is disclosed a hydraulic or manual adjustment member connected to one end of each of the cutting blades, for allowing the one end to be movably adjusted along the length of the sidewalls, so that the blades may be moved from a position substantially perpendicular to the length of the sidewall, to a position angulated therefore, so as to provide a means to prevent material graded to accumulate along the length of the blades, but to slide along the angulated blade and be deposited outside the grader apparatus. The blades are fixed in their relation to the surface itself, and cannot rotate about an axis.

The shortcoming of the device disclosed in the '331 patent was the fact that only one end of the grader blades was allowed to move along an axis, while the second end of the blades were fixed. This was a drawback, in that the blades could not be aligned in different positions from one another. They always were working in parallel formation, again with only one end movable along the frame. The inventor has developed an improved spreader/grader system which operates to solve this problem and allows the multiple blades to be fixed either in parallel, or in opposite directions depending on the need of the operator.

BRIEF SUMMARY OF THE INVENTION

The apparatus of the present invention solves the problems in the art in a simple and straightforward manner. What is provided is an improved spreader/grader system, which includes a frame having a pair of parallel sidewalls; a plurality of spreader/grader blades positioned between the sidewalls and secured within a slot along the length of each of the sidewalls, each blade having a lower edge for spreading or grading a surface upon which the spreader/grader rests; a hydraulic cylinder attached to each end of each blade to allow each blade to be moveable along the length of the sidewall in a parallel or non-parallel relationship as desired by the operator; and a hydraulic cylinder system for attaching the frame to a vehicle, such as a tractor, for pulling the spreader/grader during the spreading/grading process. The blades of the spreader/grader may alternatively be secured in fixed positions between the sidewalls of the frame with a bolt/nut combination.

Therefore, it is a principal object of the present invention to provide an improved spreader/grader system wherein a plurality of blades are positioned in fixed positions between sidewalls of the spreader/grader either parallel or non-parallel to one another; and It is a further principal object of the present invention to provide an improved spreader/grader wherein a plurality of blades are moveable along the length of each sidewall of the spreader/grader with the use of hydraulic cylinders mounted to each sidewall, operated by the operator of the vehicle pulling the grader, to move each blade in a desired position between the sidewalls.

BRIEF DESCRIPTION OF THE VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
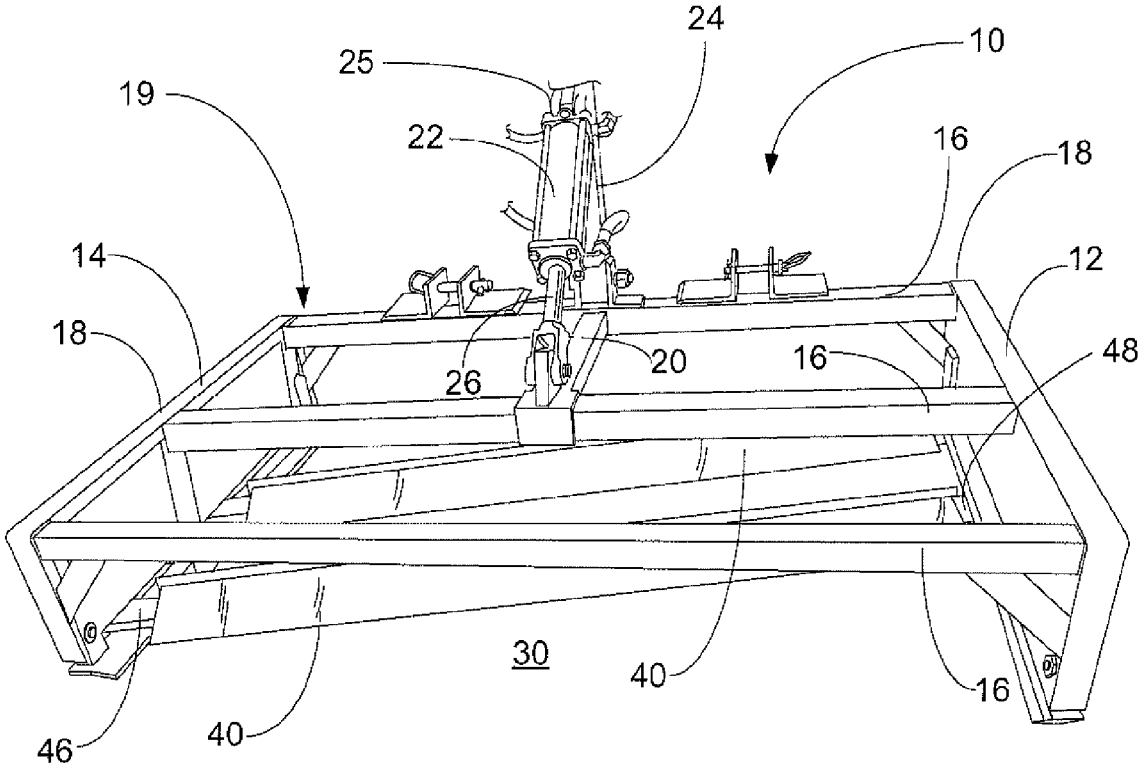
FIG. 1 illustrates an overall view of the preferred embodiment of the grader of the present invention.

FIGS. 1 through 19 illustrate the preferred embodiment of the grader of the present invention by the numeral 10. As illustrated in overall view in FIG. 1, and in top view in FIG. 2, there is first provided the spreader/grader system 10 of the present invention. As illustrated, system 10 includes a first and second parallel sidewalls 12, 14. Each sidewall 12, 14 is spaced apart and held fixed by a plurality of, preferably three, cross beams 16 along the top edges 18 of the sidewalls 12, 14, to define a frame 19. Along a third cross beam 16 there is mounted a frame 20 for securing a hydraulic cylinder 22, which extends from an upright member 24 on the frame 19 to the middle cross beam 16. The upper end 25 of the member 24 would be pivotally mounted to the vehicle (not illustrated), preferably a tractor, so that when the cylinder arm 26 is hydraulically retracted, the frame 19 is pulled up and away from the surface 30 being graded, and when the arm 26 is extended, the frame 19 is positioned along the surface 30 to be graded and may be used to hold the frame 19 in place during the grading process. Further, there is provided in the Figures, a plurality of cutting/scraping blades 40, in this case as illustrated, two blades 40 which extend and are mounted on their ends 46, 48 to the two sidewalls 12, 14.

Figure 2:
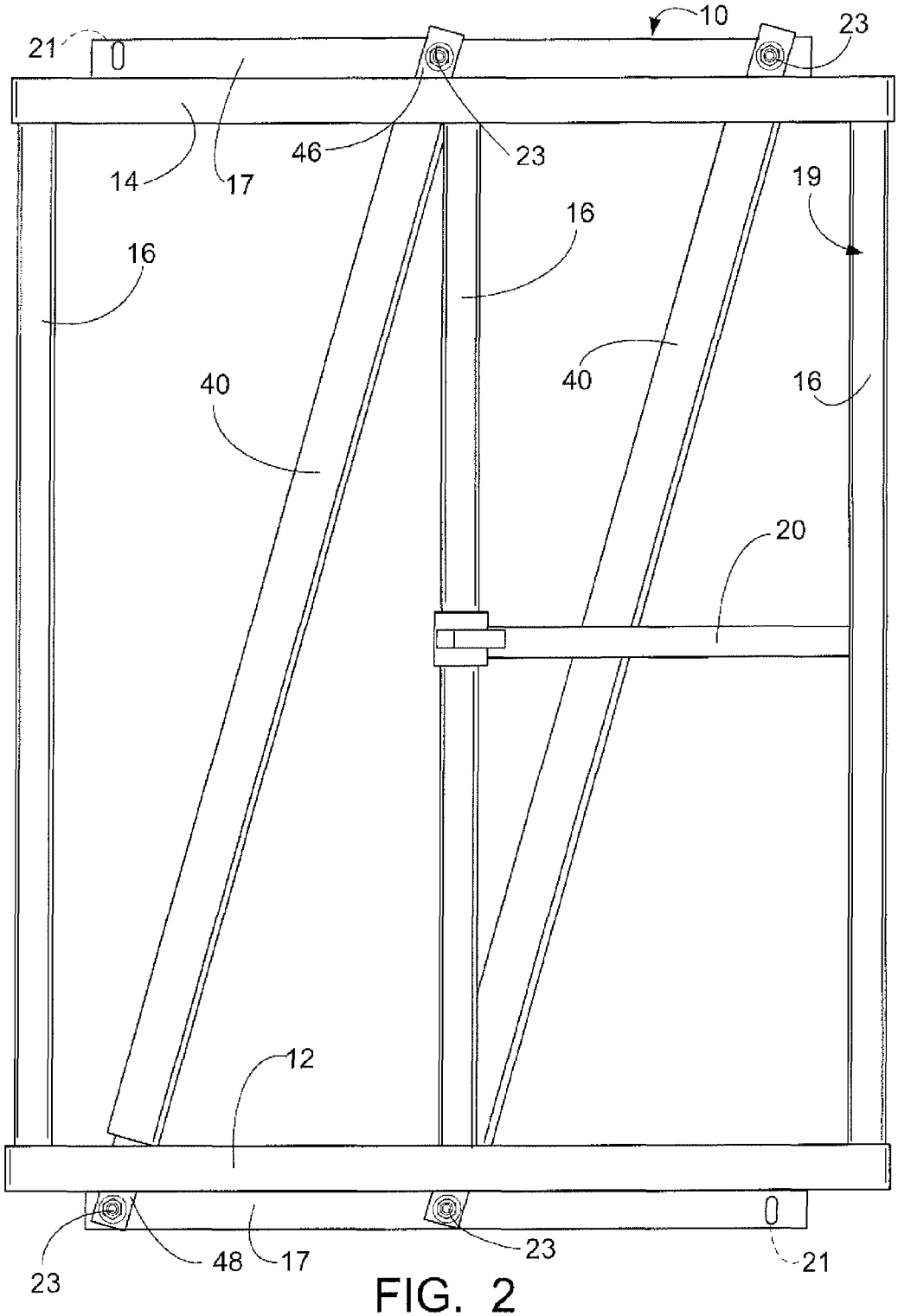
FIG. 2 illustrates a top view of the preferred embodiment of the grader of the present invention.

As seen particularly in FIG. 2, there are a pair of blades 40 in parallel relation angulated in orientation between sidewalls 12 and 14. As seen there is a shoulder member 17 extending outward from each sidewall 12, 14 and having a plurality of openings 21 in the base 25 of the shoulder 17, so that the ends 33 of the frame 30 upon which each of the blades 40 is secured, as will be discussed further, can be secured within two of the openings 21 of each base 25 via a bolt and nut combination 23, again as illustrated in FIG. 2. In that particular Figure, there are three openings 21 in the base 25 of shoulder 17, each opening 21 equally spaced along the length of the base 25 of each shoulder 17. Each blade 40 in the Figure is attached in such a manner that the two blades 40 are angulated between the first and second sidewalls 12, 14, as seen in the Figures. If one wanted to, one could release the bolt combination 23 from the base 25 of the shoulder 17 and configure the two blades 40 either in parallel relation at a right angle to the sidewalls 12, 14. In the alternative, each blade 40 could be secured in an unparallel relation as will be discussed later.

Figure 3:
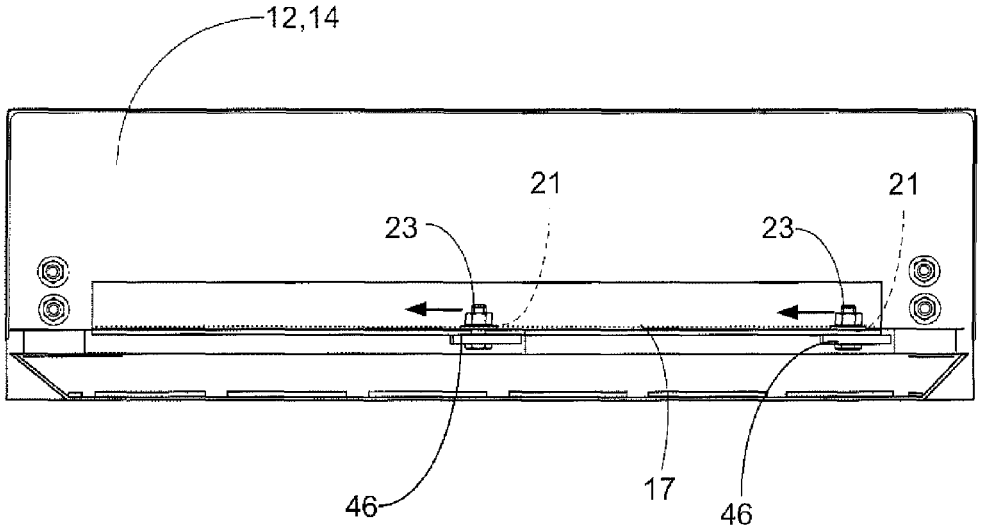
FIGS. 3 and 4 illustrate left and right end views respectively of the grader of the present invention.
Figure 4:
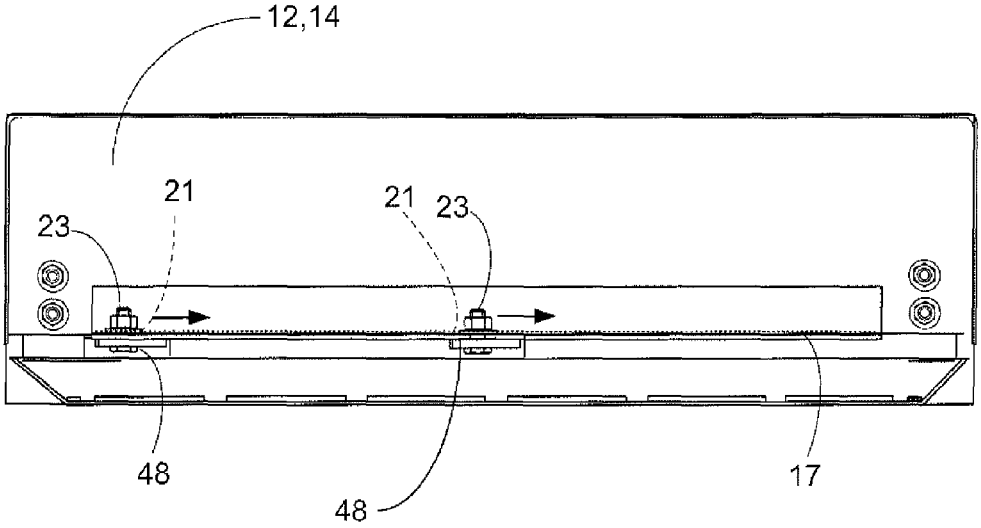

As seen in end view first in FIG. 3, the ends 33 of frame 30 to which the two blades 40 are secured are positioned at the first and second openings 21 in shoulder 17, secured in place by bolt nut combination 23. If one turns to FIG. 4, the two blades 40 have been moved to the middle and third openings 21 in the shoulder of sidewall 12 or 14, so that they are positioned in the different place along each of the sidewalls 12 and 14. In this manner, the blades 40 are allowed to work in different positions during use of the scraper/grader 10.

Figure 5:
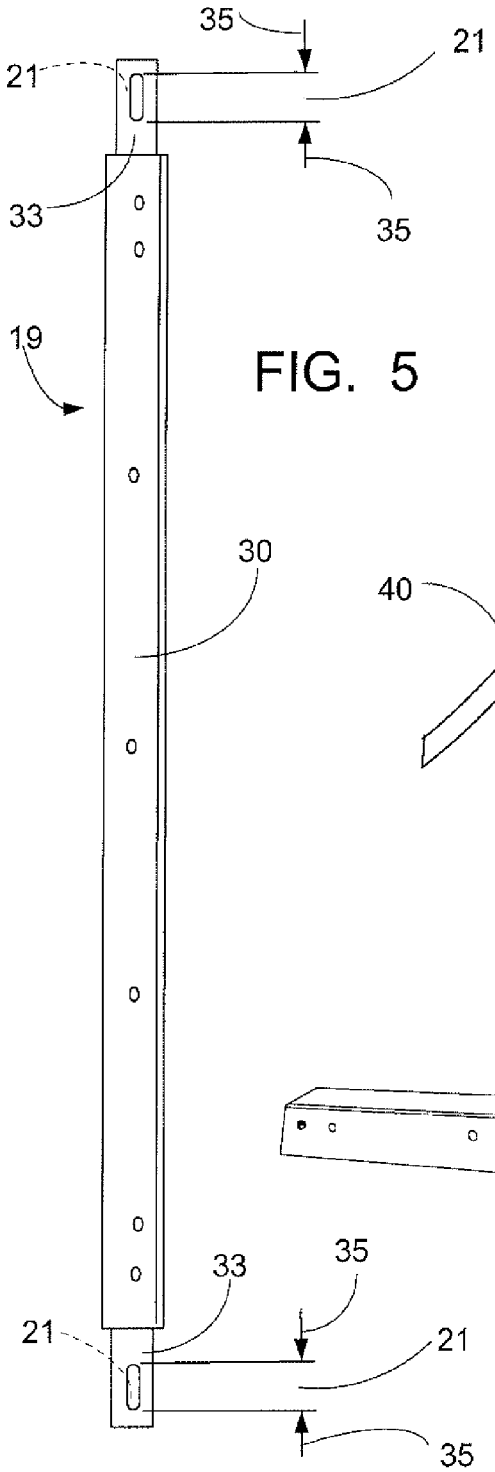
FIG. 5 illustrates a top view of a single blade that would be mounted on the grader of the present invention.
Figure 6:
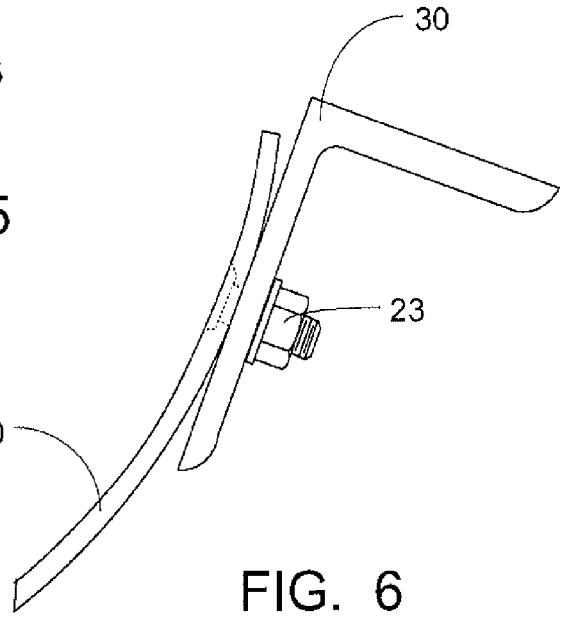
FIG. 6 illustrates an end view of the single blade as mounted on the grader of the present invention.
Figure 7:
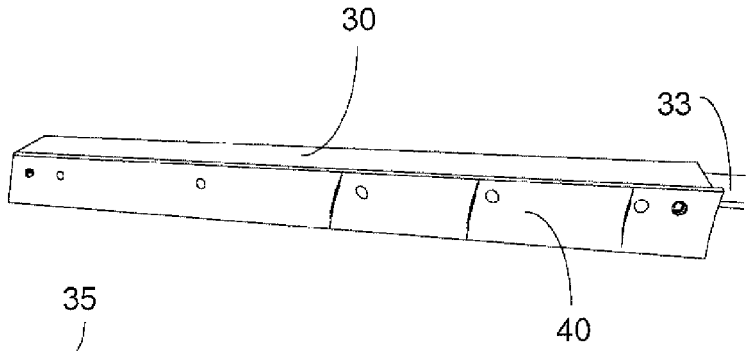
FIG. 7 illustrates an overall view of the blade as mounted onto the grader of the present invention.
Figure 8:
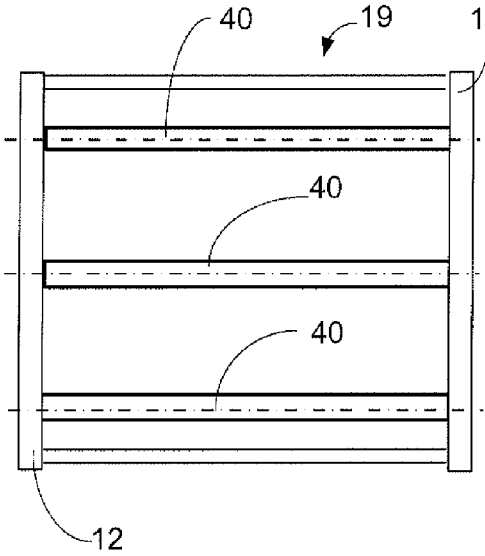
FIGS. 8 through 11 illustrate top views of multiple blades at multiple positions as mounted onto the grader of the present invention.

FIGS. 5 through 7 illustrate the manner in which each blade 40 is secured to the frame 30 and attached to each sidewall 12, 14. As seen in FIG. 5, there is a top view of the frame 30 upon which a blade 40 would be mounted. Since these blades 40 do get damaged during operation due to the fact that they are used in scraping and cutting, each blade 40 is secured along its length to frame 30 via a series of bolt nut combinations 23 as seen in FIG. 6. When a blade 40 becomes worn, the blade 40 is removed from the frame 30 and a new blade 40 is engaged thereupon as seen in FIG. 7. It should be noted in FIG. 5 that there is a slotted opening 21 in each of the ends 33 of the frame 30 so that when the frame 30 is mounted on to the grader 10 it can be shifted over in either direction (Arrows 35) so as to make the mounting secure and in the intended position.

Figure 9:
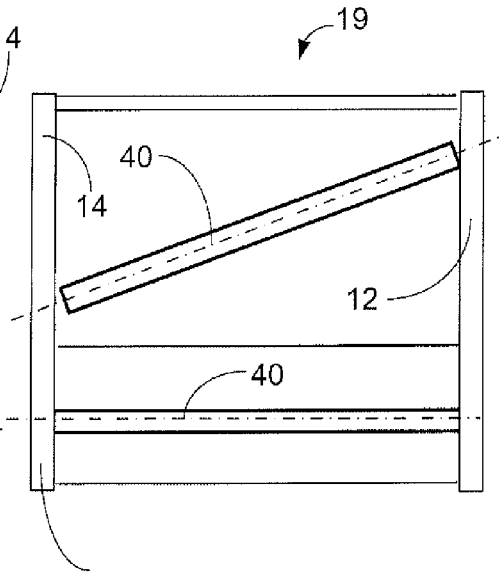
Figure 10:
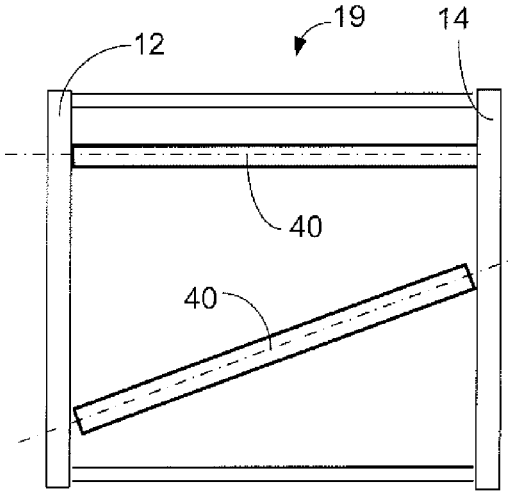
Figure 11:
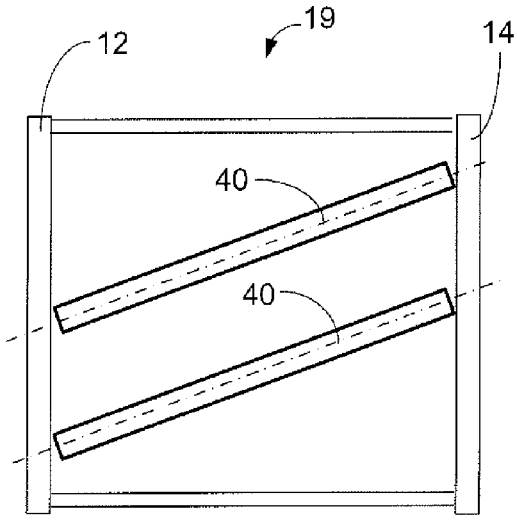
Figure 12:
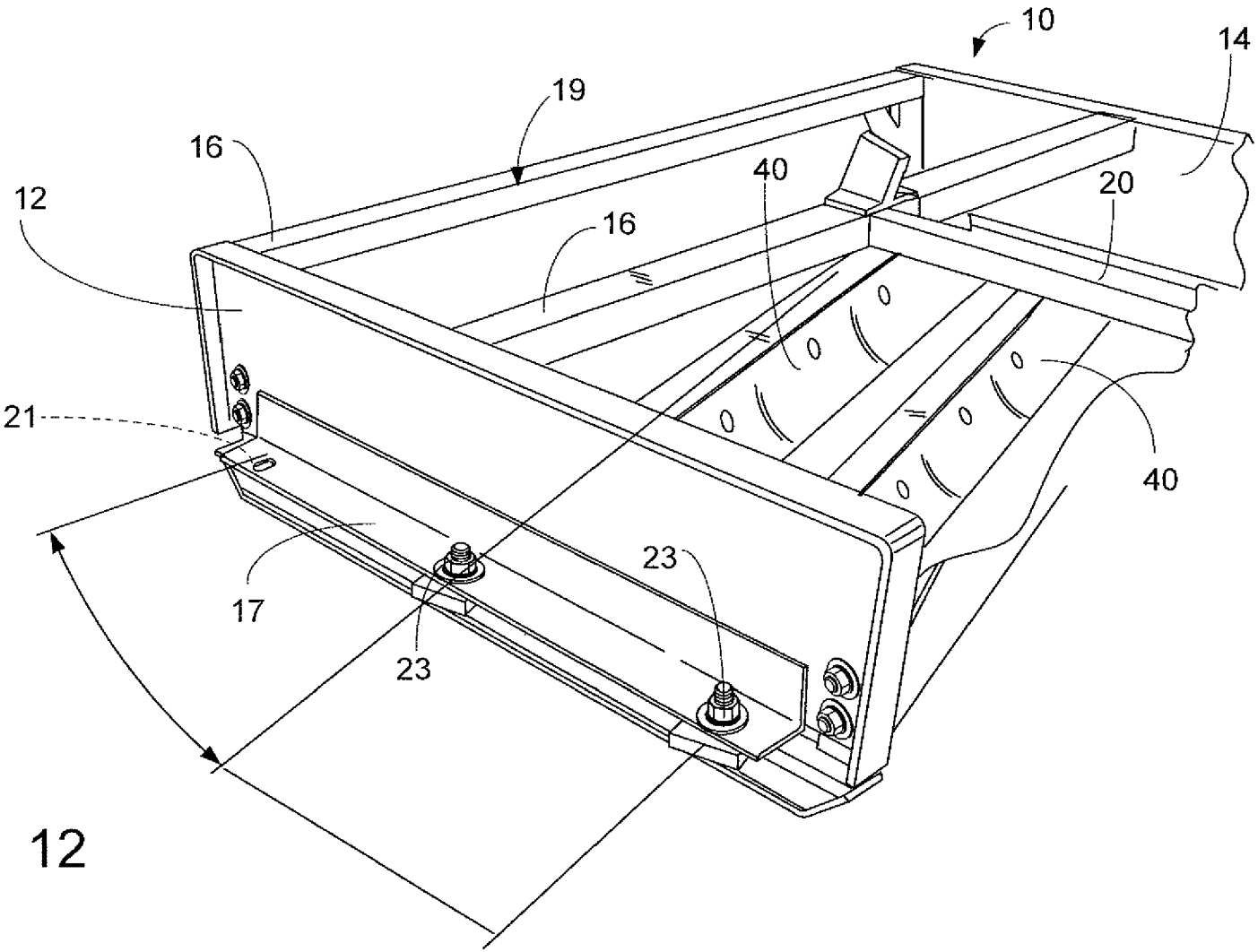
FIG. 12 illustrates an overall side view of the positioning of multiple blades as engaged to the end wall of the grader of the present invention.

Turning now to FIGS. 8-11, as was discussed earlier, since each of the blades 40 can be operated in different configurations. These Figures represent the various options that three blades 40 can be secured on to the frame 19 of the grader 40. It should be kept in mind that although these four Figures show various options, there could be other options which are not necessarily shown, so these should not be construed as limited, but only as examples. For clarity, the three blades 40 shall be referred to as upper, middle and lower blades 40, when referring to FIGS. 8 through 11. For example, in FIG. 8, there is a plurality of blades 40, where the three blades 40 mounted in parallel relation to one another on to the frame 19, and perpendicular to the side walls 12, 14, with the blades 40 secured to frame 30, which is bolted to the frame 19 with bolt/nut combination 23. In FIG. 9, upper blade 40 of the three blades 40 has been removed, and the middle blade 40 has moved from the parallel relation to lower blade 40 to a non-parallel angulated position from the lower blade 40, and bolted in place. In FIG. 10, it should be noted that the lower blade 40 has been removed, the middle blade 40 has been angulated, while the upper blade 40 remains perpendicular to the side walls 12, 14. Finally, in FIG. 11, the lower blade 40 has been removed, and the upper and middle blades 40 have been angulated vis-à-vis the side walls 12, 14, but remain in parallel relation to one another, but not in the right angle configuration with the frame sidewalls 12, 14. It is these various combinations that the grader spreader 10 can be more effectively used in different chores by the user.

FIG. 12 represents again an overall view of the spreader/grader 10 where blades 40 are illustrated as being angulated in the various angles as seen in FIGS. 8-11. It should be noted that in FIG. 12 that there are two blades 40, wherein the blades 40 are positioned in first and middle openings in the shoulder 17 along each side wall 12, 14 of the frame 19 and secured therein with bolt nut combination 23. Whereas, on the second end of the frame 19, it appears that the blades 40 have been secured in the nonparallel relation as would be represented in FIG. 11 and bolted in place for use in the grader 10. It should again be kept in mind the frame 30 is bolted into the slotted openings 21 in shoulder 17, and are allowed lateral movement between sidewalls 12, 14 during mounting.

Figure 13:
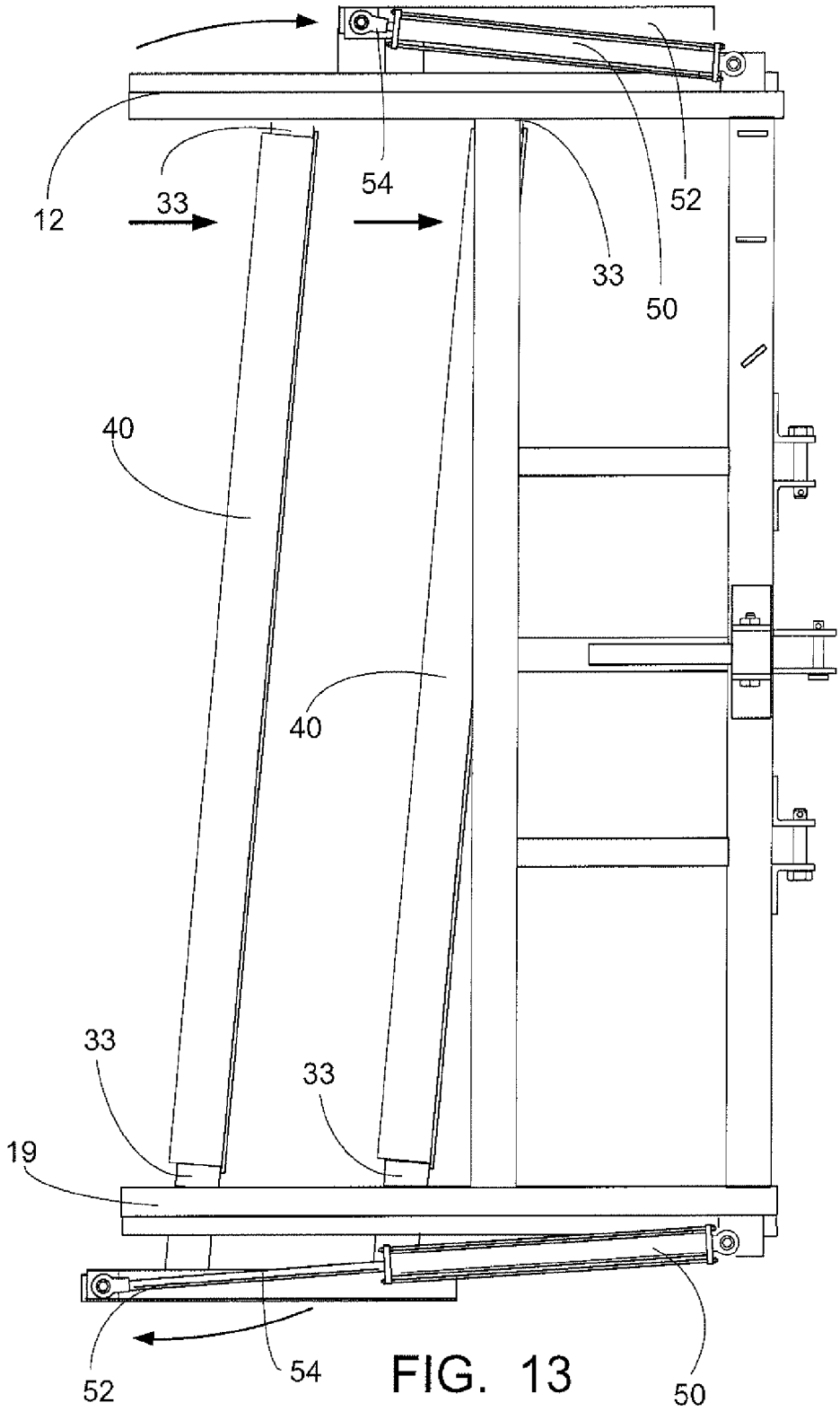
FIG. 13 illustrates a top view of the preferred embodiment of the grader of the present invention where the blades are maneuvered in offset parallel relation to one another by use of hydraulic cylinders.
Figure 14:
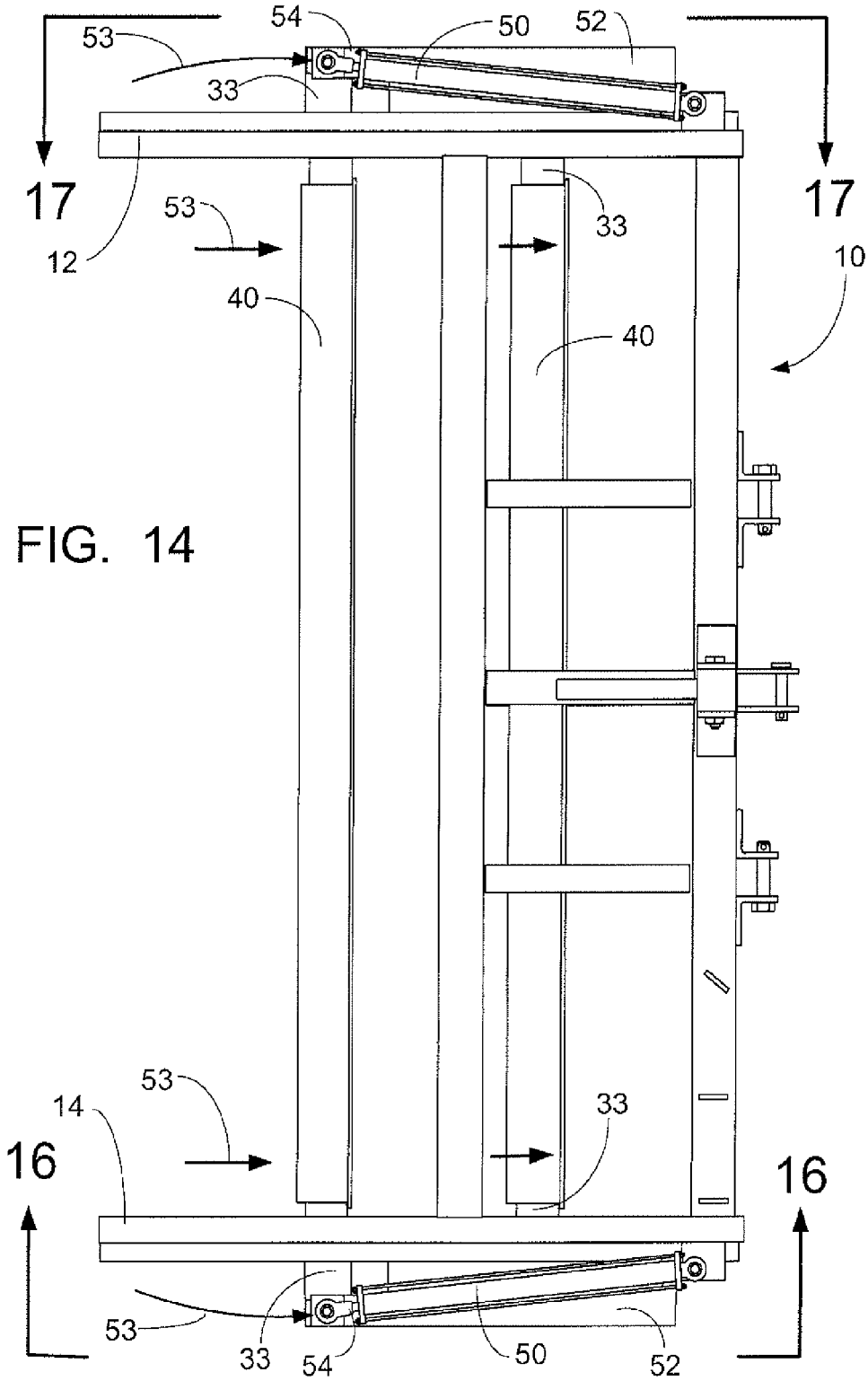
FIG. 14 illustrates a top view of the preferred embodiment of the grader of the present invention where the blades are maneuvered in direct parallel relation to one another by use of hydraulic cylinders.
Figure 15:
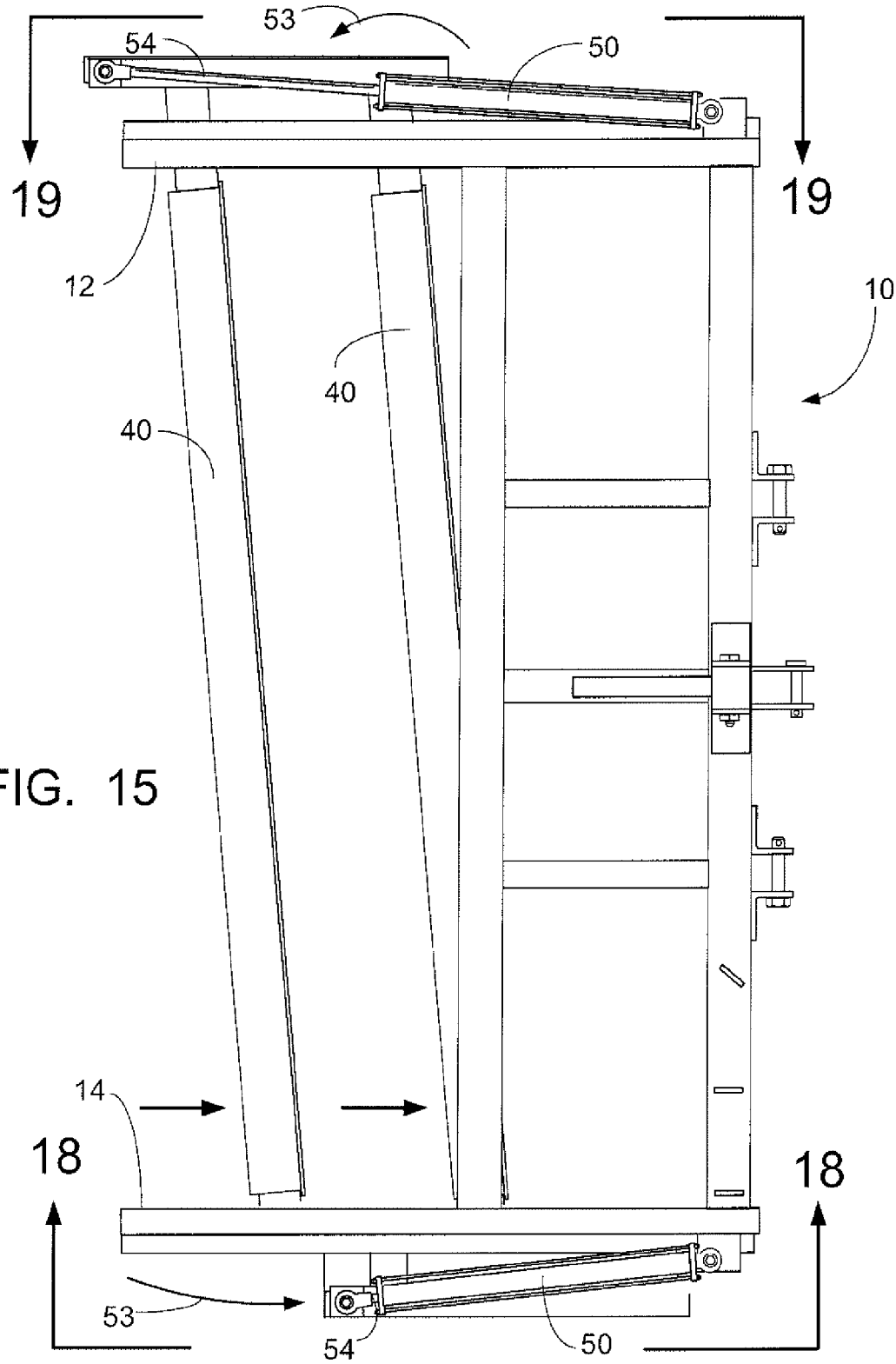
FIG. 15 illustrates a top view of the preferred embodiment of the grader of the present invention where the blades are maneuvered in offset parallel relation to one another by use of hydraulic cylinders in the opposite direction as is seen in FIG. 13.

FIGS. 13 through 19 represent various views of a second embodiment of the spreader/grader 10 wherein the blades 40 could be set in the various positions as discussed earlier with the use of hydraulic cylinders 50. In these views, the blades 40 are mounted on frames 30, and they are positioned on the frame 19. However, unlike the embodiments discussed in FIGS. 1 through 12, the ends 33 of the frames 30 are not mounted to a fixed shoulder 17 on sidewalls 12, 14. Rather the ends 33 extend through a continuous slotted opening 56 formed along the length of each sidewall 12, 14, and are fixed to a support bar 52, on the outside of each side wall 12, 14. (The slotted opening 56 is seen more clearly in FIGS. 16 through 19.) The support bar 52 also supports a hydraulic cylinder 50, as seen in FIG. 13. One end 51 of the cylinder is fixed to the frame 19, and the second end, wherein a moveable arm 54 extends and retracts from cylinder 50 is fixed to the support bar 52. In this manner, when the arm 54 is extended or retracted from the cylinder 50, through for example, hydraulic means, the movement of the arm 54 imparts movement to the support bar 52, as seen by arrows 55. In FIG. 13, the two blades 40 are secured to the support bar 52, the blades 40 move in parallel relation to one another, but in an angulated fashion, since the upper cylinder 50 is retracted, and the lower cylinder 50 is extended. In FIG. 14, the blades 40 are still in parallel relation to one another, but move perpendicular to the sidewalls 12, 14, since both cylinders 50 are in the retracted position. FIG. 15 illustrates the movement of the blades 40 in the opposite direction as the blades 40 moved in FIG. 13, with the upper cylinder 50 extended, and the lower cylinder 50 retracted.

In these series of FIGS. 13-19, there is seen the various views of the improved embodiment where the blades 40 are allowed to operate within slotted opening 56 in each wall 12, 14 of the grader 10 and are operable through the use of hydraulic cylinder 50 in order that a drive may hydraulically move the blades in various parallel or nonparallel relations if one wanted from a console on the driver of the tractor pulling the grader.

Figure 16:
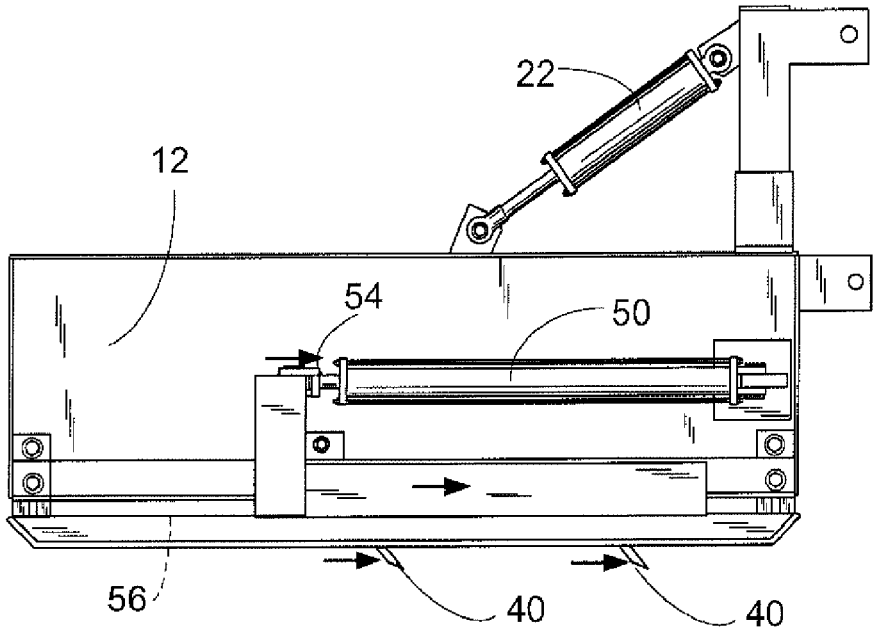
FIG. 16 illustrates the grader of the present invention as seen in lines 16-16 in FIG. 14.
Figure 17:
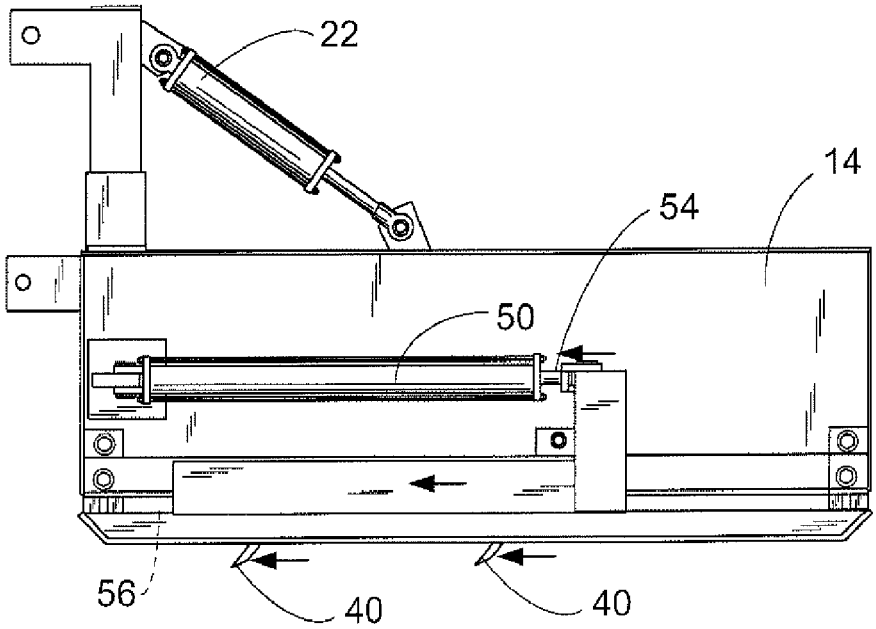
FIG. 17 illustrates the grader of the present invention as seen in lines 17-17 in FIG. 14.

FIGS. 16 and 17 represent end views of the spreader-grader 10 as discussed in regard to FIG. 14 as discussed earlier. As illustrated in FIGS. 16 and 17, the blades 40 are still in parallel relation to one another, but move perpendicular to the sidewalls 12, 14, since both cylinders 50 are in the retracted position.

Figure 18:
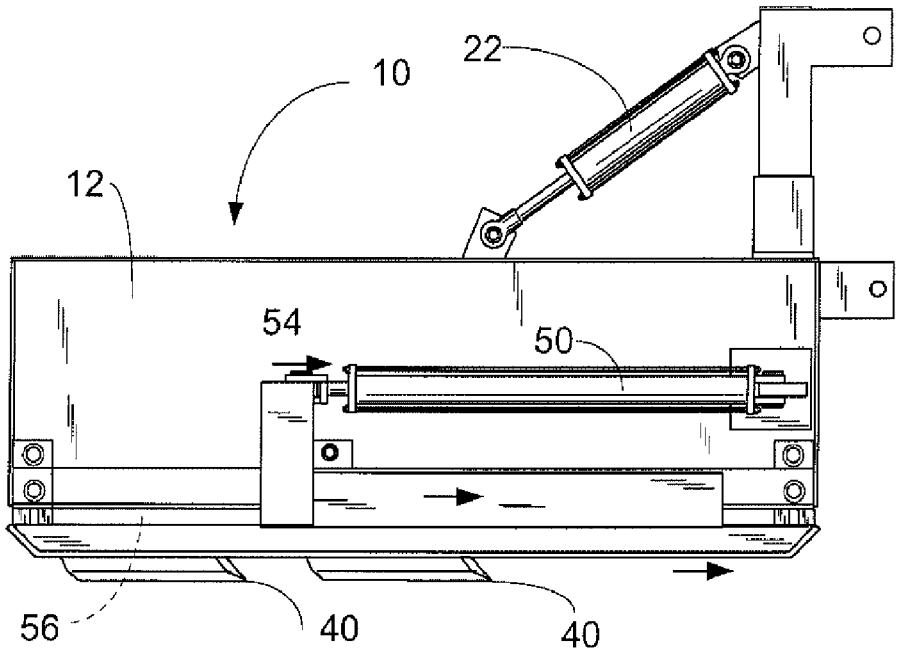
FIG. 18 illustrates the grader of the present invention as seen in lines 18-18 in FIG. 15.
Figure 19:
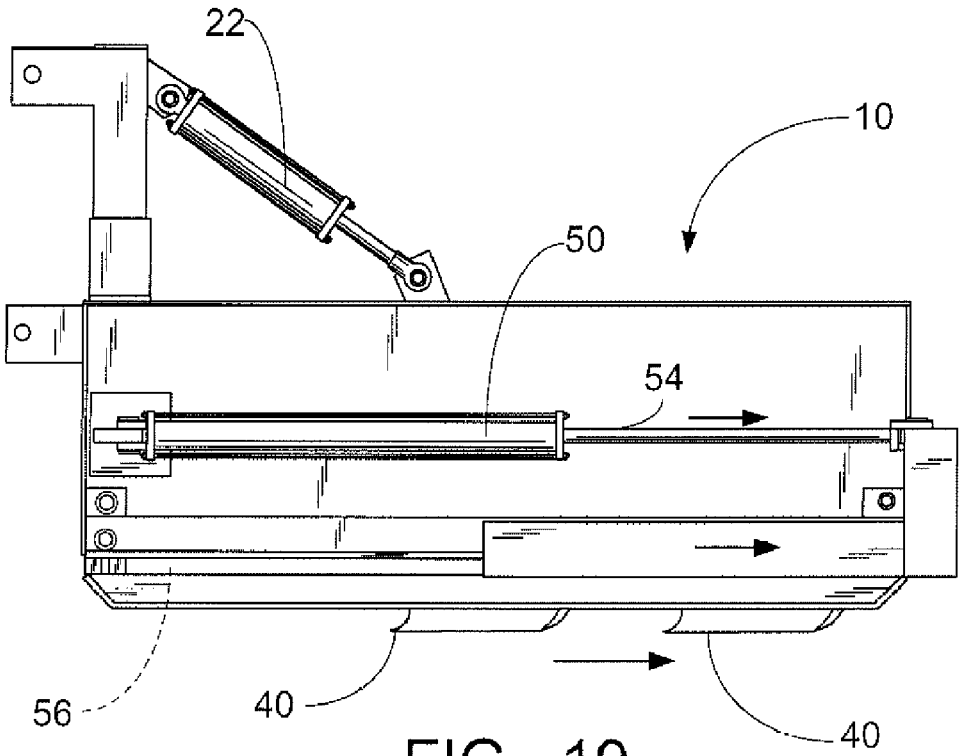
FIG. 19 illustrates the grader of the present invention as seen in lines 19-19 in FIG. 15.

Likewise, FIGS. 18 and 19 show the movement of the cylinders arm 50 in FIG. 15 where FIG. 18 illustrates in side view the movement of the cylinder 50 and lower cylinder 50 of FIG. 15, while FIG. 19 illustrates the movement of the cylinder 50 extending the arm 54 outward so that the blades 40 move along sidewalls 12, 14, but again although in parallel relation are in fact non-perpendicular with the sidewalls 12 and 14 as shown in FIG. 15.

It should be noted that the use of multiple cylinders 50 can be utilized for more than two blades 40. It is foreseen that multiple cylinders 50 may be utilized for two or more blades 40 depending on the size and the configuration of the grader. It should be made clear that these movements are all in theory operated by and operator of tractor so that he does not have to stop the tractor every time the operator wishes to reconfigure movement of the blades 40. In this manner, it is seen both ends of multiple blades 40 are movable along the entire sidewalls 12, 14 of the grader 10 and can be placed in whatever position an operator wishes depending on the wishes of the operator. It is also foreseen that the blades 40 can be operated in nonparallel relation if there were multiple cylinders 50 used; i.e. one cylinder for each blade 40 so that each of the cylinders 50 could be operated independently of the other cylinder 50 which would give the ends of the blades maneuverability in parallel and nonparallel relation across the entire sidewalls of the spreader/grader.

All measurements disclosed herein are at standard temperature and pressure, at sea level on Earth, unless indicated otherwise. All materials used or intended to be used in a human being are bio-compatible, unless indicated otherwise.

PART LIST

| Parts Number | Description |
|---|---|
| 10 | spreader/grader |
| 12, 14 | sidewalls |
| 16 | cross beams |
| 17 | shoulder |
| 18 | top edges |
| 19 | frame |
| 20 | upright frame |
| 21 | slotted openings |
| 23 | bolt/nut combination |
| 22 | hydraulic cylinder |

-continued

PART LIST

| Parts Number | Description |
|---|---|
| 24 | upright member |
| 25 | base |
| 26 | cylinder arm |
| 29 | surface |
| 30 | frame |
| 33 | ends |
| 35 | Arrows |
| 40 | blade |
| 50 | hydraulic cylinder |
| 52 | support member |
| 54 | arm |
| 56 | continuous slot |

The foregoing embodiments are presented by way of example only; the scope of the present invention is to be limited only by the following claims.

The invention claimed is:

1. An improved spreader/grader system, comprising:

a. a frame having a pair of parallel first and second sidewalls;

b. at least two spreader/grader blades having a lower edge for spreading or grading a surface upon which the spreader/grader rests, and the blades positioned parallel or non-parallel to one another between the sidewalls, with each end of the blades capable of being secured to each of the sidewalls in multiple positions;

c. first and second continuous slots formed in each of the sidewalls to allow a first end of each of the blades to slide along the first slot;

d. a hydraulic cylinder mounted to at least one of the parallel sidewalls and to the first end of at least one of the blades to move that end of the blade along the length of the first slot in the multiple positions;

e. a second end of the blade engaged through the second slot and secured to the sidewall to allow the second end of the blade to rotate as the first end moves along the first slot; and f. means for attaching the frame to a vehicle, such as a tractor, for pulling the spreader/grader during the spreading/grading process.

2. The system in claim 1, wherein the blades are secured to the frame at a point of rotation through bolting or like attachment.

3. The system in claim 1, wherein the second end of the blade may be secured to a hydraulic cylinder mounted in a second sidewall while the first end of the blade may be secured to the first sidewall to allow the first end of the blade to rotate.

4. The system in claim 1, wherein each end of each blade may be fixed and moveable along the length of the sidewall through the use of hydraulic cylinder attached to each end of each blade.

5. An improved spreader/grader system, comprising:

a. a frame having parallel first and second sidewalls;

b. at least two spreader/grader blades positioned between the first and second sidewalls with each blade having first and second ends secured within a slot along the length of each of the first and second sidewalls, and with each blade having a lower edge for spreading or grading a surface upon which the spreader/grader rests;

c. a hydraulic cylinder mounted on at least one parallel sidewall and attached to the first end of each blade to allow each blade to be moveable along the length of the slot in the first sidewall in a parallel or non-parallel relationship as desired by the operator;

d. the second end of each blade engaged through a second slot and secured to the second sidewall at a point of rotation to allow the second end of each blade to rotate as the first end of each blade moves along the first slot; and e. means for attaching the frame to a vehicle, such as a tractor, for pulling the spreader/grader during the spreading/grading process.

6. The system in claim 5, wherein the means for attaching the frame to the tractor comprises a hydraulic cylinder which has the ability to lift and lower the frame from and onto the surface to be graded.

7. The system in claim 5, wherein there may be provided at least three spreader/grader blades, each operable by a hydraulic cylinder mounted on the sidewalls of the frame.

8. An improved spreader/grader system, comprising:

a. a frame having parallel first and second sidewalls;

b. a plurality of spreader/grader blades positioned between the first and second sidewalls and secured within a slot along the length of each of the sidewalls, each blade having a lower edge for spreading or grading a surface upon which the spreader/grader rests;

c. a hydraulic cylinder mounted on each parallel sidewall and attached to each end of each blade to allow each blade to be moveable along the length of the sidewall in a parallel or non-parallel relationship to one another as desired by the operator; and d. a hydraulic cylinder for attaching the frame to a vehicle, such as a tractor, for pulling the spreader/grader and for lifting and lowering the frame from the surface during the spreading/grading process.

9. A method of fabricating and operating a spreader/grader system, comprising:

a. providing a frame having a pair of first and second parallel sidewalls;

b. positioning a plurality of spreader/grader blades between the sidewalls, the blades secured within a slot along the length of each of the sidewalls, each blade having a lower edge for spreading or grading a surface upon which the spreader/grader rests;

c. mounting a hydraulic cylinder on at least one of the sidewalls, the hydraulic cylinder attached to a first end of one of the blades;

d. mounting a second end of the at least one blade to a point of rotation on a second sidewall to allow the second end of said blade to rotate as the first end of the blade is moved by the hydraulic cylinder; and e. utilizing the hydraulic cylinders to move each blade along the length of the sidewall in a parallel or non-parallel relationship to one another as desired by the operator.

10. The method in claim 9, further comprising the step of providing a hydraulic cylinder for attaching the frame to a vehicle, such as a tractor, for pulling the spreader/grader and for lifting and lowering the frame from the surface during the spreading/grading process.

11. The method in claim 9, further comprising the step of mounting a second hydraulic cylinder on a first sidewall to a first end of a second blade and mounting a second end of the second blade to a point of rotation on the second sidewall.

* * * * *